US010093030B2

(12) United States Patent
Efthimiadis et al.

(10) Patent No.: US 10,093,030 B2
(45) Date of Patent: Oct. 9, 2018

(54) SHAVING BLADE CARTRIDGE

(71) Applicant: BIC-VIOLEX SA, Anixi, Attiki (GR)

(72) Inventors: Dimitrios Efthimiadis, Nea Kypseli (GR); Panagiotis Zafiropoulos, Wallingford, CT (US); Ioannis Bozikis, Koukaki-Athens (GR); Panagiotis Moustakas, Petroupoli (GR)

(73) Assignee: BIC VIOLEX S.A., Anixi (GR)

( * ) Notice: Subject to any disclaimer, the term of this patent is extended or adjusted under 35 U.S.C. 154(b) by 53 days.

(21) Appl. No.: 15/100,622

(22) PCT Filed: Dec. 5, 2013

(86) PCT No.: PCT/EP2013/075614
§ 371 (c)(1),
(2) Date: May 31, 2016

(87) PCT Pub. No.: WO2015/082002
PCT Pub. Date: Jun. 11, 2015

(65) Prior Publication Data

US 2016/0297086 A1 Oct. 13, 2016

(51) Int. Cl.
*B26B 21/40* (2006.01)

(52) U.S. Cl.
CPC ..... *B26B 21/4012* (2013.01); *B26B 21/4037* (2013.01); *B26B 21/4068* (2013.01)

(58) Field of Classification Search
CPC ..... B26B 21/4012; B26B 21/4068
See application file for complete search history.

(56) References Cited

U.S. PATENT DOCUMENTS 4,378,633 A * 4/1983 Jacobson ..... B26B 21/227 30/47
4,378,634 A * 4/1983 Jacobson ..... B26B 21/227 30/47
4,443,940 A 4/1984 Francis et al.
5,761,814 A * 6/1998 Anderson ..... B26B 21/227 30/50

(Continued)

FOREIGN PATENT DOCUMENTS

WO WO 96/10473 4/1996
WO WO 97/17174 5/1997

(Continued)

OTHER PUBLICATIONS

International Search Report of PCT/EP2013/075614 dated Jul. 23, 2014.

*Primary Examiner* — Sean Michalski
(74) *Attorney, Agent, or Firm* — Polsinelli PC

(57) ABSTRACT

A shaving blade cartridge includes a housing extending along a longitudinal axis, having a top side, a bottom side opposite to the top side and two longitudinal sides. The two longitudinal sides extend longitudinally along the longitudinal axis between the top and bottom sides. The housing is provided with at least one protrusion. The shaving blade cartridge further includes a cutting blade mounted in the housing between the longitudinal sides, and having a cutting edge extending along the longitudinal axis, and a clip retaining the cutting blade in the housing and having at least one leg. The leg of the clip has a recess, and the recess cooperates with the protrusion of the housing.

16 Claims, 5 Drawing Sheets

(56) References Cited

U.S. PATENT DOCUMENTS

| | | | | |
|---|---|---|---|---|
| 6,035,537 | A * | 3/2000 | Apprille, Jr. | B26B 21/227 30/346.5 |
| 6,196,519 | B1 * | 3/2001 | Utterberg | A61M 39/284 251/10 |
| 7,100,284 | B2 * | 9/2006 | King | B26B 21/225 30/49 |
| 7,168,173 | B2 * | 1/2007 | Worrick, III | B26B 21/222 30/527 |
| 7,197,825 | B2 * | 4/2007 | Walker | B26B 21/225 30/34.2 |
| 7,272,991 | B2 * | 9/2007 | Aviza | B26B 21/4068 30/50 |
| 7,669,335 | B2 * | 3/2010 | Walker | B26B 21/225 30/34.05 |
| 7,681,320 | B2 * | 3/2010 | Szczepanowski | B26B 21/225 30/34.05 |
| 2005/0198842 | A1 | 9/2005 | Walker et al. | |
| 2011/0308089 | A1 | 12/2011 | Bridges | |
| 2015/0082638 | A1 * | 3/2015 | Georgakis | B26B 21/222 30/77 |
| 2015/0174776 | A1 * | 6/2015 | Hawes | B26B 21/14 30/526 |

FOREIGN PATENT DOCUMENTS

| | | |
|---|---|---|
| WO | WO 2005/077614 | 8/2005 |
| WO | WO 2005/090015 | 9/2005 |
| WO | WO 2011/075505 | 6/2011 |
| WO | WO 2011/106370 | 9/2011 |
| WO | WO 2012/158142 | 11/2012 |
| WO | WO 2012/159022 | 11/2012 |

* cited by examiner

SHAVING BLADE CARTRIDGE

This application is a national stage application of International Application No. PCT/EP2013/075614, filed on Dec. 5, 2013, the entire content of which is incorporated herein by reference.

FIELD OF THE INVENTION

The embodiments of the present invention relate to shaving blade cartridges and shavers having such shaving blade cartridges.

BACKGROUND OF THE INVENTION

In particular, the embodiments of the present invention relate to a shaving blade cartridge that includes:

- a housing extending along a longitudinal axis, having a top side, a bottom side opposite to the top side and two longitudinal sides extending longitudinally along the longitudinal axis between the top and bottom sides, the housing being provided with at least one protrusion,
- a cutting blade mounted in the housing between the longitudinal sides, and having a cutting edge extending along the longitudinal axis, and
- a clip retaining the cutting blade in the housing and having at least one leg.

WO2012158142 describes a shaving blade cartridge having a housing and a clip having a leg which extends through an opening provided on the housing. In multiple embodiments described in WO2012158142, the leg includes a protuberance and has to be bent over itself or over the bottom of the housing to lock the clip in the opening. Therefore, after or during the mounting of the clip in the housing, it is necessary to bend the leg of the clip. Such bending does not address the security of the blades and potential assembly stresses to the clips from bending could cause the clip to not withstand the forces encountered during shaving. Moreover, this arrangement necessitates various requirements regarding manufacturing process.

WO9955499 describes a cartridge having an annular clip with two legs which cooperate with two recesses in the housing in order to retain the clip. The annular clip of WO9955499 lowers the shaving surface, which is the active surface during the shaving. Moreover, the blade security is not considered as the legs of the clip are externally accessible after cartridge assembly.

Many solutions have been developed for fastening the clip to the housing.

For example WO9610473 describes a cartridge having a clip which is wrapped around the housing. Means are disposed adjacent to end portions of the clip. The means inhibit movement of the clip end portions relative to the housing in a direction transverse to the longitudinal direction of the blade to prevent separation of the end portions of the clip one from another. Such means are an improvement. However, the risk of unintentionally removing the clip still exists.

The embodiments of the present invention have objectives to mitigate the drawbacks discussed above.

SUMMARY OF THE INVENTION

To this aim, according to an embodiment of the invention, such a shaving blade cartridge is characterized in that the leg of the clip includes a recess, and the recess cooperates with the protrusion of the housing.

With these features, the blades are retained in the housing in a secure way, without lowering the shaving surface (also called shaving window). The cooperation of the recess with the protrusion creates a position indicator which enables correct position detection of the leg of the clip. Indeed, in case of wrong positioning, the protrusion cannot cooperate with the recess, and the non-cooperation of the recess and the protrusion can be immediately seen and corrected. The risks of wrong-positioned clips are limited. Thus, the risk of blades not being retained in the housing is limited. The clip is fixed to the housing through the cooperation of the recess and the protrusion indicating correct position. Thus, it is not necessary to bend the leg of the clip over itself or over the bottom of the housing to fix the clip to the housing, which reduces the number of manufacturing steps and improves production speed. In addition, the manufacturing tolerances are improved since the total tolerances due to the bending of the leg of the clip and affecting the blade positioning are no longer applied.

In some embodiments of the present invention, a person of ordinary skill in the art might also use one or more of the following features:

- the clip includes two legs and a clip body extending between the legs, the clip body extending along a transversal axis, the transversal axis being transverse to the longitudinal axis; the two legs allow a better retention of the clip on the housing;
- the clip body is located on the top side of the shaving blade cartridge; the position of the clip enables a large shaving surface to produce an esthetical shaving blade cartridge, and the clip is easy to assemble;
- the housing is provided with two protrusions;
- each of the two legs of the clip includes a recess which cooperates with one of the two protrusions; the second protrusion provides a second maintaining area of the clip which leads to a robust assembly and minimizes the risk of unintentional disassembly of the clip;
- the protrusions are located on either side of the cutting blade; the position of the protrusion allows a robust retaining of the blades in the housing;
- the recess is a through hole; the protrusion can thus cooperate with the recess by being inserted inside the recess and through thickness of the leg of the clip;
- the clip is made of metal; thin metal, for example, enables an easy forming of the clip without lowering the resistance of the clip;
- the clip is made of polymer material, for example by injection molding;
- the recess is cut in the leg of the clip; the cut allows a precise position of the recess without making the industrial process more cumbersome;
- the housing includes a cavity extending along a lateral axis intersecting the longitudinal axis and a transversal axis, the cavity extending from the top side, the cavity being laterally delimited by a wall;
- the protrusion is provided on the wall; in other words, the protrusion is provided inside the cavity, and is therefore not visible and does not protrude from the external surfaces of the housing;
- the leg of the clip is received in the cavity; the position of the leg of the clip in the cavity increases the esthetical aspect of the shaving blade cartridge by making a clip less visible from the outside;
- the cavity is a blind hole; the disassembling of the clip is difficult for a user of the shaving blade cartridge;
- the cavity is a through hole extending along the lateral axis (or transversely to the longitudinal axis) from the top side to the bottom side of the housing; the through hole allows tolerances, which are not tight;

the bottom side of the housing includes a window, the cavity emerging in the window; the shape of the housing is optimized for a delightful use;

the leg has a free end, the free end of the leg being located in the window; the location of the free end of the leg in the window makes the disassembling of the clip difficult for a user;

the housing includes a guard bar and a rear cap, the guard bar being forward of the blade edge and the rear cap being rearward of the blade edge;

the cavity is arranged in or adjacent to the rear cap; the rear cap can, for example, be manufactured directly with the cavity;

the cavity is arranged in or adjacent to the guard bar; the guard bar can, for example, be manufactured directly with the cavity;

the protrusion is located on one of the two longitudinal sides; no cavity has to be bored;

the protrusion has a length along a lateral axis intersecting the longitudinal axis and a transversal axis, and has a height which increases along the length; the protrusion defines a sloping ramp, which allows an easy mounting of the clip and a difficult disassembling of the clip;

the shaving blade cartridge includes two clips retaining the blades in the housing, each clip having at least one leg;

each of the two clips has two legs, each of the two legs cooperating with one protrusion provided on the housing, one of the two legs of each of the two clips being located in front of the cutting blade, where the other one of the two legs of each of the two clips is located rearward of the cutting blade; the holding function is strengthened;

the housing is provided with four cavities, each of the four cavities having a protrusion, each leg being received in a cavity and cooperating with a protrusion;

the shaving aid member extends between the two clips of the shaving blade cartridge; the clips do not limit the active surface of the shaving aid;

the guard bar extends between the two clips of the shaving blade cartridge; the clips do not limit the active surface of the guard bar;

The embodiments of the present invention are also directed to a shaver that includes a handle and a shaving blade cartridge as described above, where the shaving blade cartridge are connected to the handle.

BRIEF DESCRIPTION OF THE DRAWINGS

Other characteristics and advantages of the embodiments of the present invention will readily appear from the following description of one of its embodiments, provided as non-limitative examples, and shown in the accompanying drawings.

On the different figures, the same reference signs designate like or similar elements.

DETAILED DESCRIPTION

Figure 1:
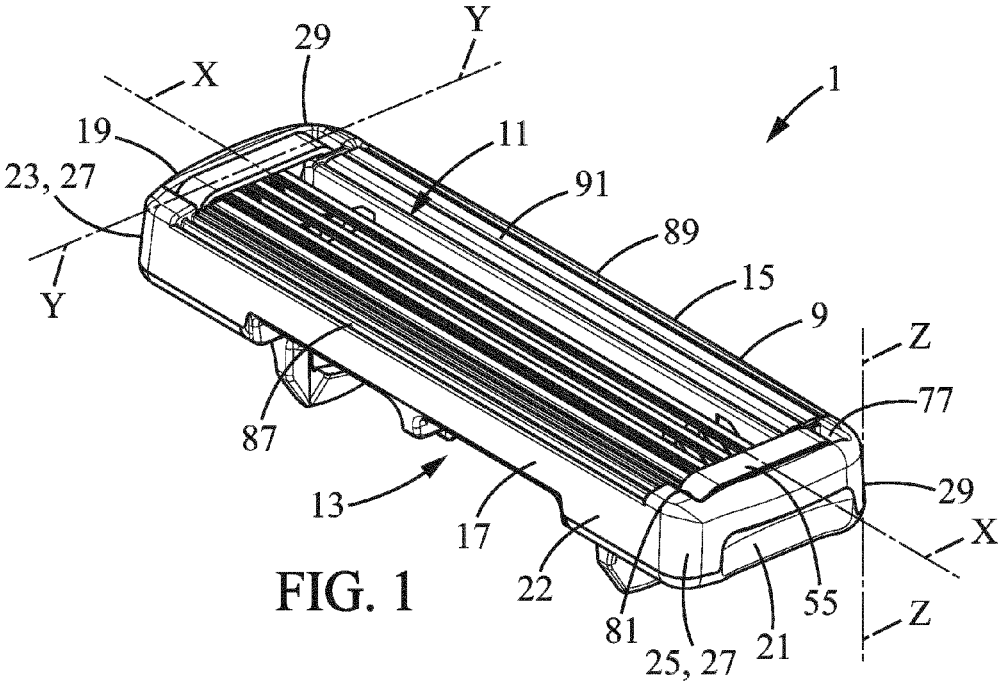
FIG. 1 is a perspective view of a shaving blade cartridge according to an embodiment of the present invention, the cartridge comprising a housing, three blades and two clips retaining the blades in the housing.

FIG. 1 shows a shaving blade cartridge 1 of a wet razor, a shaver 3 (shown in FIG. 9) where the blades of which are not driven by a motor relative to the shaving blade cartridge.

Figure 9:
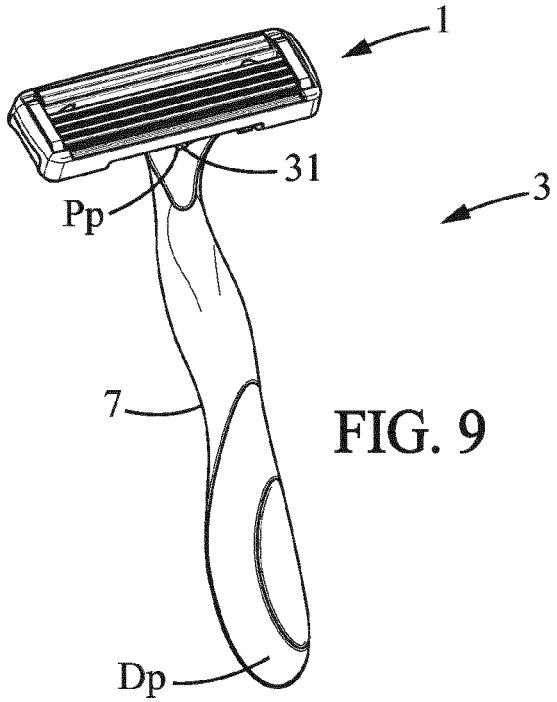
FIG. 9 shows a perspective view of a shaver with a handle and a shaving blade cartridge, according to the invention.

As illustrated in FIG. 9, the shaving blade cartridge 1 is attached to a handle 7 extending in a handle direction between a proximal portion Pp and a distal portion Dp. The handle 7 can pivot with regard to the shaving blade cartridge 1. In other embodiments of the present invention, the handle may also be fixed with regard to the shaving blade cartridge. The handle direction may be curved or include one or several straight portions. The shaving blade cartridge 1 can, for example, be releasably connected to the shaver handle 7 through a lock-and-release mechanism.

As depicted in FIGS. 1, 2, 4, 5, 6, 7, 8 and 9, the shaving blade cartridge 1 includes a housing 9. The housing 9 extends along a longitudinal axis X-X. Viewed from the top (see FIG. 4), the housing 9 has a rectangular general shape. However, in some embodiments of the present invention, the general shape of the housing 9 may be different, and for example, the housing 9 could have an oval shape. The housing 9 includes a top side 11, a bottom side 13 opposite to the top side 11, and two longitudinal sides 15, 17, for example, a first and second longitudinal side 15, 17. For example, the bottom side 13 is adapted to be arranged adjacent to the handle 7 whereas the top side 11 is arranged opposite to the handle 7. The top side 11 and the bottom side 13 can be parallel to each other. The first longitudinal side 15 extends along the longitudinal axis X-X. The second longitudinal side 17 and the first longitudinal side 15 are facing each other. The second longitudinal side 17 may be approximately parallel to the first longitudinal side 15, especially when the first and second longitudinal sides 15, 17 are flat. The first and second longitudinal sides 15, 17 can also have subtle or noticeable opposing radii. The first and second longitudinal sides 15, 17 can also have curved surfaces. The second longitudinal side 17 also extends along the longitudinal axis X-X. The first and the second longitudinal side 15, 17 each extend in a lateral direction along a lateral axis Z-Z, between the top side 11 and the bottom side 13 of the housing 9. The first side 15 can be forward or rearward of the blade edges according to at least one embodiment of the present invention. The lateral axis Z-Z intersects the longitudinal axis X-X. For example, the lateral axis is orthogonal or perpendicular to the longitudinal axis X-X.

Figure 2:
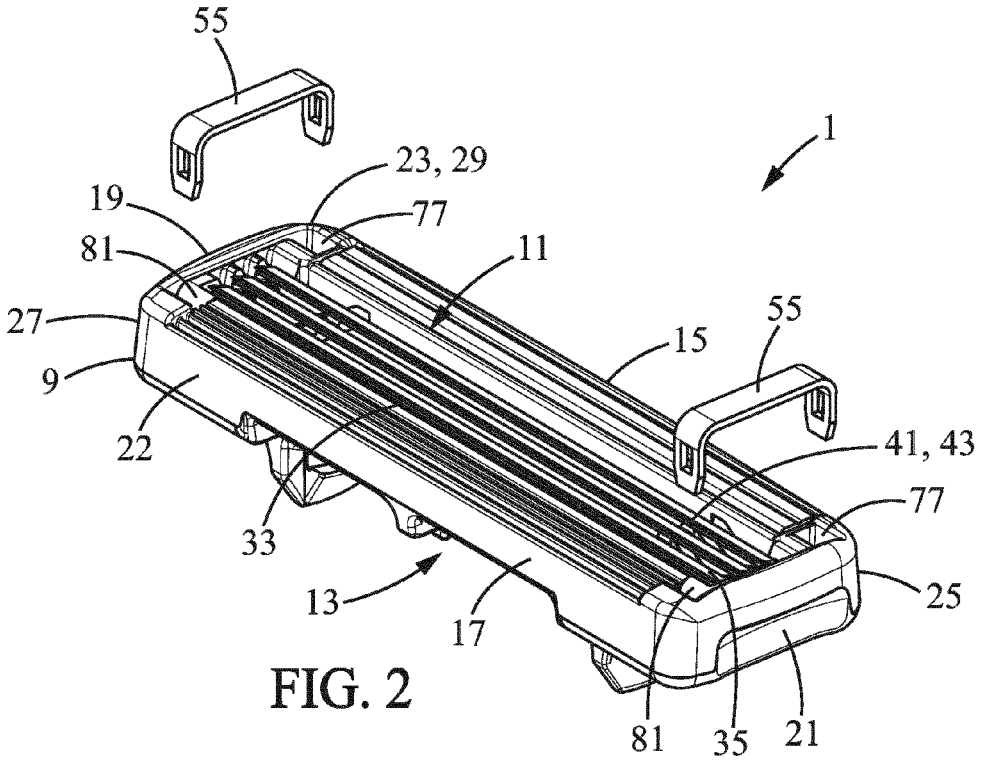
FIG. 2 shows a partially exploded view of the shaving blade cartridge of FIG. 1, in which the two clips are separate from the housing.

The housing 9 may also include, as can be seen in FIG. 2, first and second lateral sides 19, 21 which extend between the first and second longitudinal sides 15, 17, along a transversal axis Y-Y, the transversal axis Y-Y being, for example, orthogonal to the longitudinal axis X-X and to the lateral axis Z-Z. In an embodiment of the present invention, the transversal axis could be not orthogonal to the longitudinal axis X-X and to the lateral axis Z-Z. The first and second lateral sides 19, 21 are arranged in the lateral direction along the lateral axis Z-Z, between the top side 11 and the bottom side 13. The first and second lateral and longitudinal sides 15, 17, 19, 21 form together the external surface 22 of the housing 9. The first and second lateral sides 19, 21 both join the longitudinal ends 23, 25 of the first and second longitudinal sides 15, 17. In a similar way, the first and second longitudinal sides 15, 17 both join the free ends 27, 29 of the first and second lateral sides 19, 21.

The housing 9 can be made of plastic material. However, other materials may be used. Moreover, the housing can be made with a combination of two or more different materials. For example, a part of the housing may be made with a first material, whereas the other part of the housing is made with a second material. The housing 9 can for example include, on the bottom side 13, a connection mechanism 31 adapted to connect the handle 7. The connection mechanism 31 can thus allow the release and/or the attachment of the shaving blade cartridge 1 to the handle 7.

The housing 9 also includes a blade receiving section 33, as represented in FIG. 2. The blade receiving section 33 or blade receiving area may have a general rectangular shape. The blade receiving section 33 is arranged on the top side 11 of the housing 9. The blade receiving section 33 defines a recess and is adapted to receive a cutting blade 35. The shaving blade cartridge 1 includes at least one cutting blade 35 (also called blade in the rest of the description). As depicted in FIGS. 1, 2, 4, 5, 6, 7 and 8, the shaving blade cartridge 1 includes three cutting blades 35. In other embodiments of the present invention, the shaving blade cartridge 1 can include more or less than three cutting blades 35. For example the shaving blade cartridge 1 can include five cutting blades. The description below is made with reference to the figures representing the shaving blade cartridge 1 including three cutting blades 35. However, as previously mentioned, the number of cutting blades may be different.

The blades 35 are mounted in the housing 9 in the blade receiving section 33 between the first and second longitudinal sides 15, 17 of the housing and between the first and second lateral sides 19, 21 of the housing 9. As shown in FIGS. 1, 2, 4, 5, 6 and 8, each blade 35 extends longitudinally along the longitudinal axis X-X. Each cutting blade 35 has a first and second end 37, 39 along the longitudinal axis X-X. The first end 37 of the cutting blades 35 is directed toward the first lateral side 19 of the housing 9, whereas the second end 39 of the cutting blade 35 is directed toward the second lateral side 21 of the housing 9. Each cutting blade 35 includes a cutting edge 41. The cutting edge 41 extends along the longitudinal axis X-X. The cutting edge 41 of the cutting blade 35 is accessible at the top side 11 of the housing 9 to cut hair during shaving.

For example, the cutting blades 35 are L-shaped. The cutting blades 35 thus have a cutting edge portion 43, a guided portion 45, and a bent portion 47 which is intermediate to the cutting edge portion 43 and the guided portion 45. The cutting edge portion 43 extends along a cutting edge portion axis. Advantageously, the cutting edge portion axis of all cutting blades 35 are positioned parallel to each other.

Figure 7:
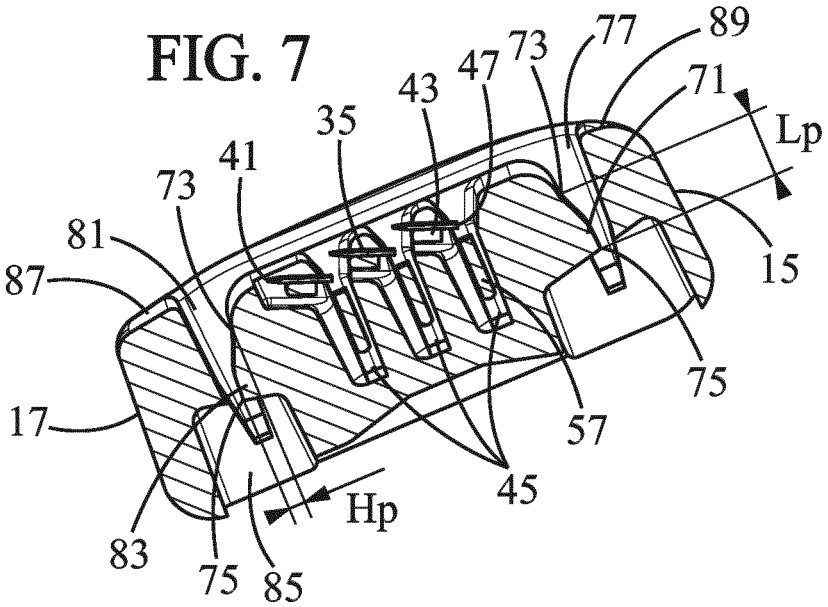
FIG. 7 shows a cross-sectional view of the shaving blade cartridge of FIG. 1.

In an embodiment of the present invention, each cutting blade 35 is freely mounted in the housing 9, as can be seen in FIG. 7. More precisely, the blades 35 are movably mounted in the blade receiving section 33. Each cutting blade 35 is, for example, borne (or carried) by two elastic fingers 49, 51 (see FIG. 5). The elastic fingers 49, 51 can be molded as a single piece with the housing 9 and can extend in the blade receiving section 33 towards each other and upwardly from both lateral sides 19, 21 of the housing 9. The guided portions 45 of the cutting blades 35 may be slidingly guided in slots 53 (see FIG. 5) provided in the housing 9. For example, the cutting blade 35 can be a supported blade having a cutting edge 41 fixed on a blade support 57, as represented in FIG. 7, which includes the guided portion 45 and the bent portion 47. In this case the blade support 57 is carried by the elastic fingers 49, 51.

In other embodiments of the present invention, the blades could be bent blades, as described for instance in patent application WO2013/050606.

Each cutting blade 35 is retained in the housing by a clip 55.

The clip 55 includes at least one leg 59. The leg 59 of the clip 55 has a recess 61. As shown in FIG. 2, the leg 59 of the clip 55 has a free end 63. The recess 61 is located toward the free end 63 at a non-zero distance of the free end 63 of the leg 59 of the clip 55. In other embodiments of the present invention, the recess 61 may be located on other areas of the leg 59 of the clip 55. The leg of the clip 55 is shorter than the distance between the top side 11 and the bottom side 13.

The clip can be made of a formable material, for example a thin sheet of suitable metal. However, other materials may be considered. The width "l" of the clip can be sensibly constant along its length. Also, as represented on FIG. 3, the thickness "ep" of the clip 55 can be constant along its length.

In other embodiments of the present invention, the width "l" and the thickness "ep" of the clip can be variable.

The clip 55 may be made of metal material, for example thin metal. The recess 61 may be cut in the leg 59 of the clip 55.

Figure 3:
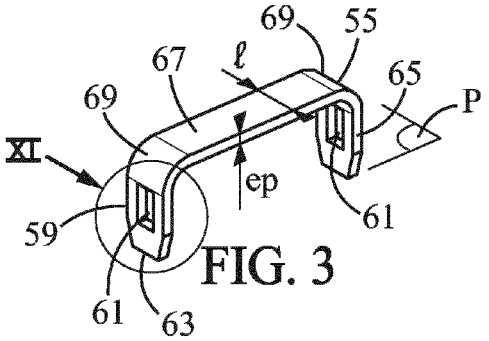
FIG. 3 is a perspective view of a clip of FIG. 2.
Figure 4:
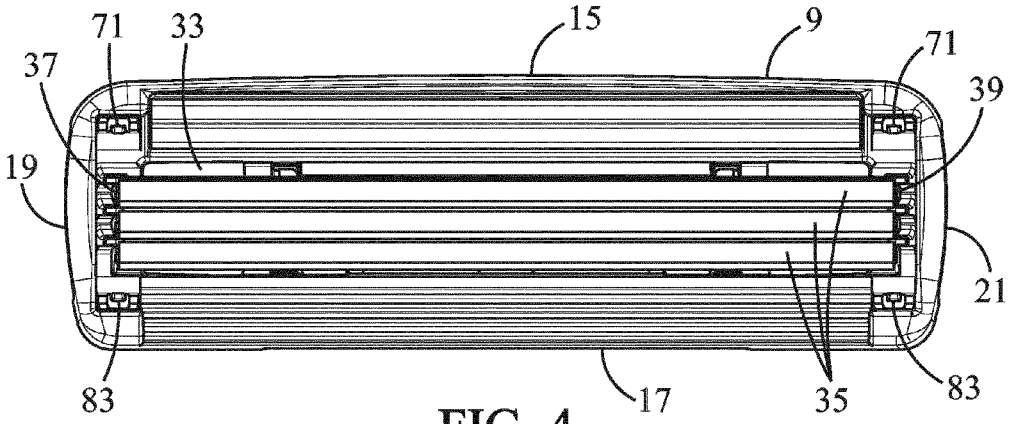
FIG. 4 shows a top view of the housing of the shaving blade cartridge of FIG. 1 with three blades.
Figure 5:
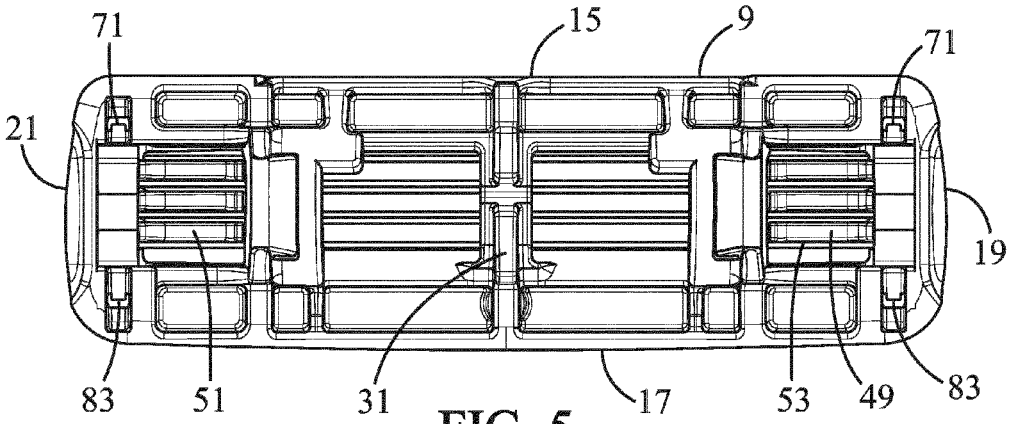
FIG. 5 shows a bottom view of the housing of the shaving blade cartridge of FIG. 1 with three blades.
Figure 6:
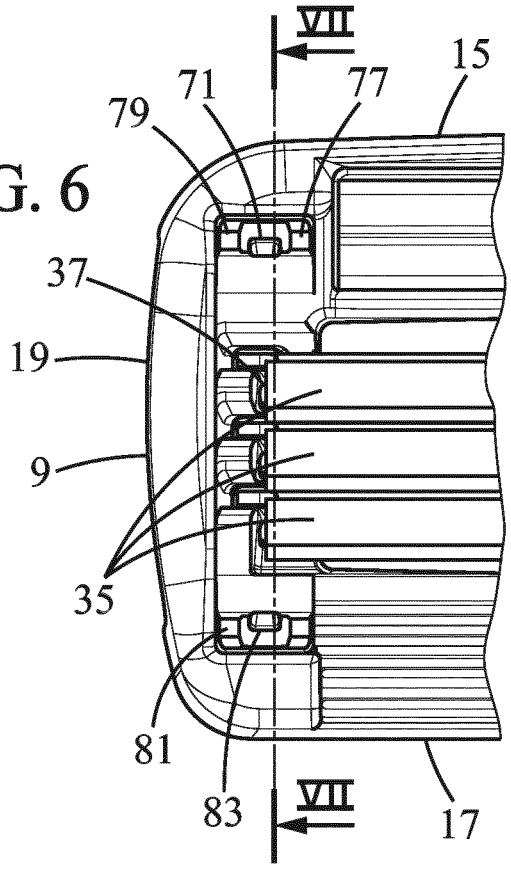
FIG. 6 shows an enlarged view of a portion of the housing of FIG. 4.

In the embodiment of the present invention depicted in FIG. 3, the clip 55 includes two legs 59, 65, for example a first leg 59 and a second leg 65. The two legs 59, 65 are connected together by a clip body 67. The clip body 67 extends between the two legs 59, 65. As shown in FIG. 3, each leg 59, 65 has a recess 61. In at least one embodiment of the present invention, only one leg may have a recess. The shape of the clip may be different, for example with three legs extending from a clip body. In other embodiments of the present invention, the clip can have only one leg connected to a clip body. The legs 59, 65 of the clip 55 are shorter than the distance between the top side 11 and the bottom side 13.

In the embodiment of the present invention of FIG. 3, the clip 55 is in a rest position (i.e. not subject at any external forces), and the legs 59, 65 of the clip 55 extend perpendicular to the clip body 67. The clip 55 has a U-shape. The base of the U includes the clip body 67, and the lateral sides of the U are defined by the first and second legs 59, 65. More precisely, a bent portion 69 connects the leg 59, 65 of the clip 55 and the clip body 67. The legs 59, 65, the bent portions 69, and the clip body 67 are a one-piece body. The legs 59, 65 can be parallel to each other in a rest-position (i.e. when no external force is applied to the clip 55). The clip 55 may be manufactured by bending of a sheet metal. The free end 63 of one of the legs 59, 65 or of both legs 59, 65 may be tapered (sensibly V-shaped).

In another embodiment of the present invention, the clip can also be manufactured by injection molding. A polymer material (for example a reinforced polymer material) can be molded to form the clip, and then the clip can be pressed to reach its final form. The clip in polymer material can be then coated or plated.

In a mounted position of the clip 55, as represented in FIG. 1, the clip body 67 extends along the transversal axis Y-Y. The clip body 67 is located on the top side 11 of the shaving blade cartridge 1. More precisely, the clip 55 is arranged facing the cutting edge 41 of the cutting blade 35 and retain the cutting blade 35 in the housing 9. In the mounted position, both legs 59, 65 of the clip 55 extend along the lateral axis Z-Z. In other embodiments of the present invention, the legs of the clip may extend along other directions.

The recess 61 of the legs 59, 65 cooperate with a protrusion 71 provided on the housing 9.

Figure 11A:
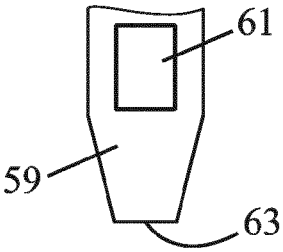
FIGS. 11*a*, 11*b*, and 11*c* show front views of a portion of the leg of the clip referenced XI in the FIG. 3, according to different embodiments of the invention.
Figure 11B:
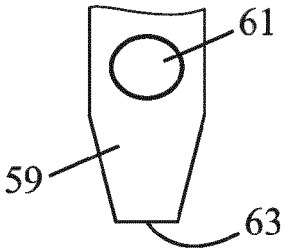

The recess 61 can have different shapes. For example, the recess 61 can be square or rectangular, as represented in figure l la. The recess can also be circular, as represented in FIG. 11*b*. In the embodiments of the present invention represented in FIGS. 11*a* and 11*b*, the recess 61 is "closed" meaning that the recess 61 is accessible from a front side of the leg of the clip or from a back side of the leg of the clip. The recess is not accessible from a lateral side of the leg of the clip 55.

Figure 11C:
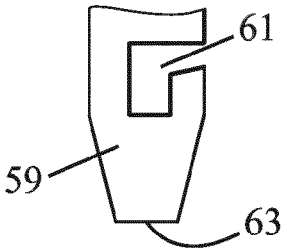

In another embodiment of the present invention, the recess can be sensibly L-shaped, such as represented in FIG. 11*c*. More particularly, the recess 61, depicted in FIG. 11*c*, is "open". The recess 61 has a portion which extends beyond the limit of the clip 55, such that the recess 61 is accessible from a transverse side of the clip. For example, the recess 61 can have a first portion which is rectangular and extends along the length of the leg of the clip 55 and a second portion which extends along a direction perpendicular to the length of the clip, and beyond the limit of the clip. An "open" recess 61 can make the cooperation with the protrusion 71 easier.

The protrusion 71 is provided on the housing 9 and can have a shape which enables a good cooperation of the recess 61 with the protrusion 71. The protrusion 71 can have a first end 73 and a second end 75. The second end 75 can project beyond the first end 73, as best described below.

In at least one embodiment of the present invention, as represented in FIGS. 1, 2, 4, 5, 6 and 7, the housing 9 has a cavity 77, and the protrusion 71 is located in the cavity 77. The cavity 77 is defined by a wall 79, and the protrusion 71 is on the wall 79. In other words, the protrusion 71 protrudes from the wall 79.

The wall 79 defining the cavity 77 may be straight, in order to facilitate the mounting of the legs 59, 65 of the clip 55 in the cavity. In addition the walls may be orthogonal to the shaving plane, which is the plane defined as being the plane passing through the surfaces of the housing directly located forward of the cutting blade edge and rearward of the cutting blade edge. In another embodiment of the present invention, the walls are angled with regard to the shaving plane. For example, the angle between the wall 79 and the shaving plane may be between 70° and 100°.

The cavity 77 may have a rectangular shape, a square shape or a circular shape. The legs of the clip 59, 65 are inserted into the cavity 77. For example, the shape of the cavity is complementary to the shape of the legs of the clip. The shape of the clip 55, and more particularly of the legs 59, 65, is complementary to the shape of the cavity 77 and can be different from the shape described above with reference to FIG. 3. Viewed in a transverse section, the shape of the legs 59, 65 of the clip 55 can be rectangular, square, or oval.

Figure 10A:
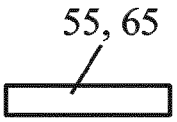
FIGS. 10*a*, 10*b*, 10*c*, and 10*d* show schematic cross sectional views in the cut plane P represented in FIG. 3 of the leg of the clip according to different embodiments of the present invention.
Figure 10B:
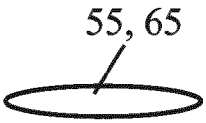

More precisely, viewed in a transverse section, the shape of the legs 59, 65 of the clip 55 can be rectangular as represented in FIGS. 10*a*. The legs 59, 65 thus cooperate with a rectangular-shaped cavity 77, as represented in FIG. 2.

However, the shape of the legs 59, 65 of the clip 55 can also be oval, as represented in 10*b*. The leg 59, 65 can then be inserted in a cavity 77 which is oval.

Figure 10C:
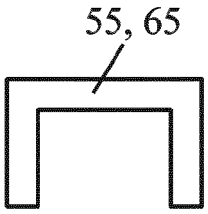

In another embodiment of the present invention, as represented in FIG. 10*c*, the legs 59, 65, viewed in a transverse section, can be U-shaped, with a base extending between two lateral parts. The legs 59, 65 can then be inserted in a cavity 77, which is also U-shaped.

Figure 10D:
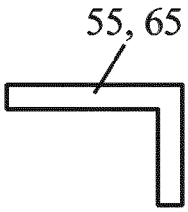

The legs 59, 65, viewed in a transverse section, can also be L-shaped, as represented in FIG. 10*d*. The leg 59, 65 can then be inserted in a cavity 77, which is also L-shaped.

The cavity 77 may be a blind hole. In other embodiments of the present invention, the cavity 77 may be a through hole extending transversely to the longitudinal axis (X-X) form the top side 11 to the bottom side 13 of the housing 9.

In the first embodiment of the present invention, represented in FIGS. 1, 2, 4, 5, 6 and 7, the housing 9 has two cavities 77, 81, for example a first cavity 77 and a second cavity 81. Each of the cavities 77, 81 includes a protrusion 71. The first cavity 77 may be located at one side of the blade toward the first longitudinal side 15, and the second cavity 81 is located on the other side of the blade, toward the second longitudinal side 17.

In the first embodiment of the present invention, represented in FIGS. 1, 2, 4, 5, 6 and 7, the first leg 59 of the clip 55 is inserted in the first cavity 77 and the second leg 65 of the clip 55 is inserted in the second cavity 81.

Figure 8:
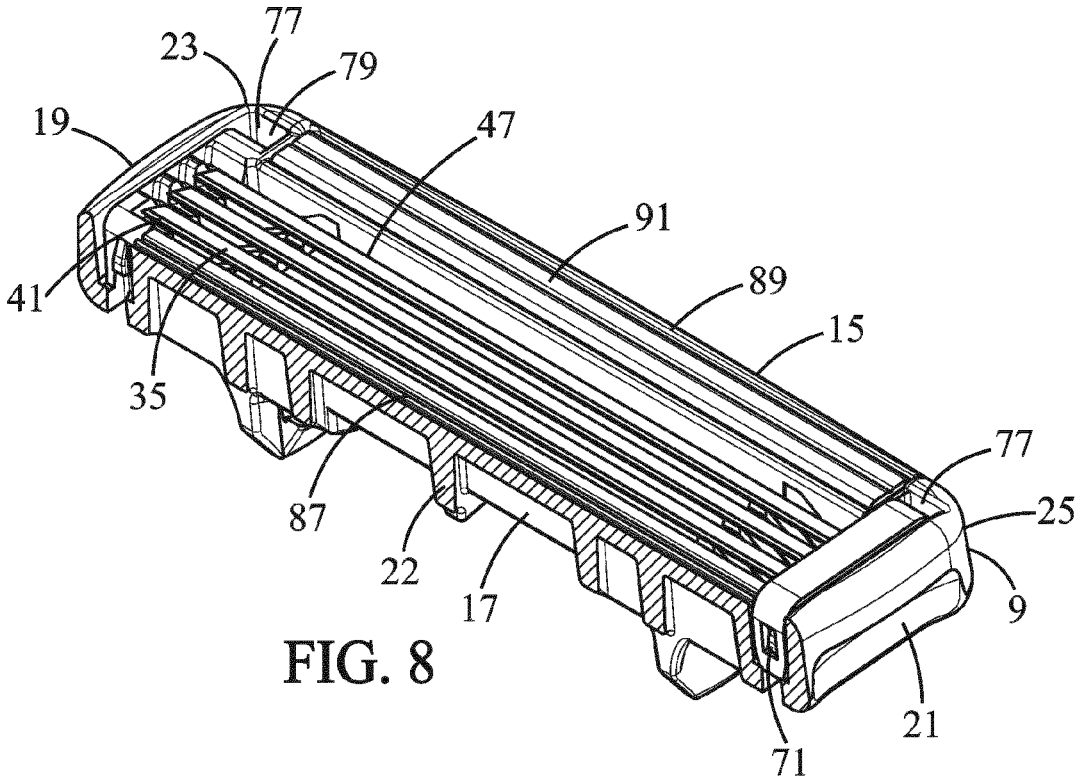
FIG. 8 is a perspective view of a shaving blade cartridge according to a second embodiment of the invention.

In a second embodiment of the present invention, as represented in FIG. 8, the protrusion 71 may be located on one of the two longitudinal sides 15, 17. More precisely, the protrusion 71 may be located either on the first longitudinal side 15, or on the second longitudinal side 17. As represented in FIGS. 7 and 8, a first protrusion 71 is located on the first longitudinal side 15 whereas a second protrusion 83 is located in a cavity 77 which is toward the second longitudinal side 17. In this embodiment of the present invention, represented in FIG. 8, at least one leg of the clip extends outside the shaving blade cartridge. For example, a groove which includes the protrusion 71 may be provided on the second longitudinal side 17, in which one leg of the clip 55 extends. The thickness of the groove can then be the same as than the thickness "ep" of the clip 55. Thus, the leg of the clip 55 does not protrude outside of the housing 9 from the groove.

In an embodiment of the present invention, the housing 9 can include two protrusions 71, 83, one being located on the first longitudinal side 15, the other being provided on the second longitudinal side 17. The protrusions 71, 83 protrude from one of the longitudinal sides 15, 17. The protrusions 71, 83 can alternatively protrude from one of the lateral sides 19, 21, for example when the recess 61 of the clip is L-shaped, such as represented in FIG. 11*c*.

The protrusions 71, 83 may also be located on other areas of the housing 9, as long as the protrusions 71, 83 cooperate with the recess 61 provided on the clip 55 such that the clip 55 can retain the cutting blades 35 in the housing 9.

As previously mentioned, the protrusions 71, 83 can include a first and a second end 73, 75. For example, and as represented in FIGS. 7 and 8, the first end 73 is located toward the top side 11 of the housing 9, whereas the second end 75 is located toward the bottom side 13 of the housing 9. The protrusions 71, 83 have a length "Lp" along the lateral axis Z-Z which intersects the longitudinal axis X-X and the transversal axis Y-Y, and has a height "Hp". The height "Hp" of the protrusions 71, 83 increases along the length "Lp". The second end 75 of the protrusions 71, 83 projects beyond the first end 73 of the protrusion 71, 83. In other words, the protrusions 71, 83 form a sloping ramp, which allows for easy mounting of the clip 55 and difficult disassembling of the clip 55. The clip 55 is inserted from the top side 11 of the shaving blade cartridge 1. Thus, while inserting, the free end 63 of the clip 55 comes at first into contact with the first end 73 of the protrusion 71, 83. The free end 63 of the clip 55 slides along the protrusions 71, 83 along the lateral axis Z-Z. While sliding along the protrusions 71, 83, the legs 59, 65 of the clip 55 is supported by the protrusions 71, 83, and the free end 63 of the clip 55 will deviate from its rest position (free of any external constraints) under the force exerted by the protrusions 71, 83, in a direction opposed to the protrusions 71, 83. The free end 63 of the clip 55 will slide beyond the second end 75 of the protrusions 71, 83 until the outer contours of the recess 61 come in front of the outer contours of the protrusions 71, 83. The legs 59, 65 of the clip 55 are then no longer supported by the protrusions (in other words, no force is exerted by the protrusions 71, 83) and the legs 59, 65 of the clip 55 return to a rest-position. In others words, the legs 59, 65 of the clip 55 come back elastically to a rest position, such that the recess 61 of the legs 59, 65 is around the protrusions 71, 83. The protrusions 71, 83 emerge from the recess 61 (or goes through the thickness of the clip 55).

In the first embodiment and as represented more precisely in FIG. 7, the cavities 77, 81 are through holes, and the bottom side 13 of the housing can include a window 85 (which is a kind of recess or cavity). The window 85 forms a slot in the bottom side 13 of the housing 9. The cavities 77, 81 emerge in the window 85.

In a mounted position of the clip 55, as represented in FIG. 7, the free end 63 of the legs 59, 65 of the clip 55 is located in the window 85. Thus the free end 63 does not protrude from the housing 9.

The housing 9 can include a guard bar 87 and a rear cap 89. The guard bar 87 is forward of the cutting edge 41. The guard bar 87 is located in front of the cutting edges 41. The rear cap 89 is located rearward of the cutting edge 41. In other words, the rear cap 89 is behind the cutting edge 41. The rear cap 89 can be provided with a lubricating strip. In other words, the rear cap 89 can include, as shown in FIGS. 1, 2, 4 and 8, a shaving aid member 91. The shaving aid member 91 extends along the longitudinal axis X-X. The shaving aid member 91 can have the same length along the longitudinal axis X-X with the rear cap 89, or is smaller in length than the rear cap 89.

The cavities 77, 81 may be located in or adjacent to the rear cap 89. The cavities 77, 81 may also be arranged (or located) in or adjacent to the guard bar 87. The cavities 77, 81 may also be arranged adjacent to the rear cap 89 and to the guard bar 87. For example, as represented in FIGS. 1, 2, 4, 8 the first cavity 77 is arranged in the rear cap 89, whereas the second cavity 81 is arranged in the guard bar 87. The shape of the protrusions 71, 83 is complementary of the shape of the recess 61. In other words, the dimensions of the protrusions 71, 83 are the same, or are in the same order of magnitude with the dimensions of the recess 61. The recess 61 may be larger than the protrusions 71, 83.

In the embodiment of the present invention represented in FIGS. 1, 2, 4, 5, 8, the shaving blade cartridge includes two clips 55. The two clips 55 may be similar For example, the clips 55 may have each a leg 59 cooperating with a protrusion 71 on the guard.

In other embodiments of the present invention, the two clips may be different. For example, where one of the clips has two legs extending each in a cavity 77, 81, the second clip may have two legs cooperating with protrusions provided on the longitudinal sides of the housing. For example, the legs of the second clip may extend outside the shaving blade cartridge, whereas the legs of the first clip may extend inside the shaving blade cartridge 1. Alternatively, a first leg of each clip 55 may extend in a cavity whereas a second leg of each clip 55 extends outside the shaving blade cartridge.

The distance between the two clips 55 is smaller than the length of the cutting blade 35. The two clips 55 each have a portion which is in front of the cutting blade 35. The portions of the clips 55 in front of the cutting blade retain the cutting blade 35. The portion of clips 55 in front of the cutting blade 35 touches the cutting blade 35 when the blades are in a rest-position (for example when no external force is applied to the shaving blade cartridge).

The clip 55 can include an aluminum alloy material. The blade 35 can be made of a steel alloy material. The different materials between the blade and clip enhance cathodic protection and blade longevity.

The clip 55 can have mechanical elastic properties, which enable the elastic deformation of the leg of the clip 55 in order to provide a gripping action carried only by the inherent resistance to deformation of the material for the fastening of the leg of the clip with the protrusion. The clip 55 of the first embodiment of the present invention, as shown in FIGS. 1, 2, 4 and 5, can be fastened to the housing 9 with the following steps:

In a first step, the legs 59, 65 of the clip are positioned in front of the cavities 77, 81. In a second step, the clip 55 is moved toward the housing 9 such that the legs 59, 65 of the clip 55 are inserted within the cavities 77, 81. The legs 59, 65 of the clip 55 are pushed along the lateral axis Z-Z in the direction of the shaving blade cartridge until the clip 55 reaches its final position, in which the recess 61 of the legs 59, 65, cooperates with the protrusion 71, 83, such as previously described.

In the second embodiment of the present invention, represented in FIG. 8, the steps to fasten the clip to the housing are the following: In a first step, the second legs 65 of the clip 55 is positioned in front of the cavity 77, whereas the first leg of the clip is positioned in axially offset along the lateral axis Z-Z relative to the protrusion 71. In a second step, the clip 55 is moved toward the housing 9 such that the second leg 65 of the clip 55 is inserted within the cavity 77, whereas the first leg of the clip surrounds the first longitudinal side. The legs 59, 65 of the clip 55 are pushed along the lateral axis Z-Z in the direction of the shaving blade cartridge until the clip 55 reaches its final position, in which the recess 61 of the legs 59, 65, cooperates with the protrusions 71, 83, such as previously described.

The clip 55 cannot be removed from its final position in a normal use. The clip is permanently positioned. Indeed, when being pulled along the lateral axis Z-Z in a direction opposite to the shaving blade cartridge 1, the second end 75 of the protrusion 71, 83 forms an abutment for the external contours of the recess, such that the clip 55 is locked within the cavity 77, 81. Moreover, the protrusion can be plastically deformed.

The cooperation of the recess 61 and the protrusion 71, 83 forms a locking device. The actions of mounting the clip 55 with regard to the housing 9 and locking the clip 55 in the housing 9 are simultaneous. No additional bending step is necessary to fasten the clip to the housing. The clip 55 is secured inside the guard and/or the rear cap of the housing 9, which limits the risk of removing the clip unintentionally.

The invention claimed is:

1. A shaving blade cartridge comprising:

a housing extending along a longitudinal axis, having a top side, a bottom side opposite to the top side and two longitudinal sides extending longitudinally along the longitudinal axis between the top and bottom sides, the housing including at least one cavity extending from the top side toward the bottom side of the housing and laterally delimited by surrounding walls, at least one protrusion disposed in the cavity and extending from one of the surrounding walls, at least one cutting blade mounted in the housing between the two longitudinal sides, and having a cutting edge extending along the longitudinal axis, at least one clip retaining the at least one cutting blade in the housing and having at least one leg, wherein the at least one leg of the at least one clip includes a recess, and the recess cooperates with the at least one protrusion provided in the at least one cavity of the housing.

2. The shaving blade cartridge according to claim 1, wherein the at least one clip includes a clip body and the at least one leg includes two legs, the clip body extending between the two legs, the clip body extending along the transversal axis, the transversal axis being transverse to the longitudinal axis, and wherein the clip body is located on the top side of the housing of the shaving blade cartridge.

3. The shaving blade cartridge according to claim 2, wherein the at least one protrusion includes two protrusions, the recess of each of the two legs of the at least one clip cooperates with one of the two protrusions, and wherein the protrusions are located on either side of the at least one cutting blade.

4. The shaving blade cartridge according to claim 3, wherein the recess is a through hole, the at least one clip is made of metal, and the recess is cut in the at least one leg of the at least one clip.

5. The shaving blade cartridge according to claim 1, wherein the at least one cavity is laterally delimited by the wall, the at least one protrusion is provided on the wall, and the at least one leg of the at least one clip is received in the at least one cavity.

6. The shaving blade cartridge according to claim 1, wherein the at least one cavity is a blind hole.

7. The shaving blade cartridge according to claim 1, wherein the at least one cavity is a through hole extending from the top side to the bottom side of the housing.

8. The shaving blade cartridge according to claim 7, wherein the bottom side of the housing includes a window, the at least one cavity emerging in the window, and wherein the at least one leg has a free end, the free end of the at least one leg being located in the window.

9. The shaving blade cartridge according to claim 1, wherein the housing includes a guard bar and a rear cap, the guard bar being forward of the cutting edge and the rear cap being rearward of the cutting edge, and the at least one cavity is arranged in or adjacent to the rear cap.

10. The shaving blade cartridge according to claim 1, wherein the housing includes a guard bar and a rear cap, the guard bar being forward of the cutting edge and the rear cap being rearward of the cutting edge, and the at least one cavity is arranged in or adjacent to the guard bar.

11. The shaving blade cartridge according to claim 1, wherein the at least one protrusion has a length along a lateral axis intersecting the longitudinal axis, and has a height which increases along the length.

12. A shaver comprising a handle and a shaving blade cartridge according to claim 1, the shaving blade cartridge being connected to the handle.

13. A shaving blade cartridge comprising:

a housing extending along a longitudinal axis, having a top side, a bottom side opposite to the top side and two longitudinal sides extending longitudinally along the longitudinal axis between the top and bottom sides, the housing including at least one cavity extending from the top side toward the bottom side of at least one of the two longitudinal sides and laterally delimited by surrounding walls, at least one protrusion disposed in the at least one cavity and extending from one of the surrounding walls, at least one cutting blade mounted in the housing between the two longitudinal sides, and having a cutting edge extending along the longitudinal axis, at least one clip retaining the at least one cutting blade in the housing and having at least one leg, and wherein the at least one leg of the at least one clip includes a recess, and the recess cooperates with the at least one protrusion.

14. The shaving blade cartridge according to claim 13, wherein the at least one clip includes two clips retaining the at least one cutting blade in the housing, each of the two clips having at least one of the at least one legs.

15. The shaving blade cartridge according to claim 14, wherein the at least one leg of each of the two clips includes two legs, each of the two legs cooperating with a respective one of the at least one protrusion provided on the housing, one of the two legs of each of the two clips is located in front of the cutting blade, and the other one of the two legs of each of the two clips is located rearward of the cutting blade.

16. The shaving blade cartridge according to claim 15, wherein the at least one cavity includes four cavities, the at least one leg of the two legs of each of the two clips being received in at least one of the four cavities the other of the at least one leg of the two legs of each of the two clips cooperates with the at least one protrusion provided on one of the two longitudinal sides.

* * * * *